US005199335A

United States Patent [19]

Arnold et al.

[11] Patent Number: 5,199,335

[45] Date of Patent: Apr. 6, 1993

[54] FLEX-HEAD TOOL WITH LOCKING FEATURE

[75] Inventors: Robert L. Arnold, Leola; Kenneth J. Taggart, Columbia; James D. Diffenderfer, Lancaster, all of Pa.

[73] Assignee: Easco Hand Tools, Inc., Lancaster, Pa.

[21] Appl. No.: 881,204

[22] Filed: May 11, 1992

[51] Int. Cl.[5] ..... B25G 1/06

[52] U.S. Cl. ..... 81/177.8; 81/177.7

[58] Field of Search ..... 81/177.8, 177.9, 177.7, 81/177.1, 489; 403/92, 93, 98

[56] References Cited

U.S. PATENT DOCUMENTS 1,155,937 10/1915 Lerfald ..... 81/177.8
1,286,506 12/1918 Beery ..... 81/177.8
4,711,145 12/1987 Inoue ..... 81/177.8 X

*Primary Examiner*—D. S. Meislin
*Attorney, Agent, or Firm*—Leonard Bloom

[57] ABSTRACT

A locking flex-head wrench has a handle pivotably connected to a tool head, and an improved locking mechanism comprising a unitary locking spool seated within the handle and conveniently manipulated to lock or unlock the tool head at a desired angular position with respect to the handle. The locking mechanism is of simple design and can be manufactured, assembled, and repaired at minimum expense.

28 Claims, 9 Drawing Sheets

FLEX-HEAD TOOL WITH LOCKING FEATURE

BACKGROUND OF THE INVENTION

1. Field of the Invention

The present invention relates to tools for imparting torque to a workpiece and, more particularly, to a flex-head wrench having a handle which is pivotable orthogonally with respect to the plane of the tool head and an improved locking feature for selectively locking the pivoting handle in place.

2. Description of the Background

Many different wrenches have been developed each with specialized feature(s) adapted for particular working conditions.

One such condition frequently arises in a crowded or enclosed environment. In this situation, the turning arc of the wrench may be blocked or limited by neighboring objects or structures. A variety of flex-head wrenches has been developed which overcomes this problem by allowing an operator to adjust the angular position of the handle orthogonally with respect to the plane of tool head. This way, the operator can maneuver the wrench handle around the obstruction.

In its simplest form, a flex-head wrench includes a handle portion joined to a tool-head at a pivot joint. If the turning arc of the handle becomes obstructed, the operator simply adjusts the angle of the handle. This way, most obstructions can be avoided without removing the tool head from the workpiece. Unfortunately, control of the handle is easily lost when high torque is applied, and the handle has a tendency to change position. This may injure the operator.

Certain flex head wrenches provide an additional feature by which the handle may be locked in a desired angular position with respect to the plane of the tool head. The locking feature helps to maintain control of the wrench even when high torque is being applied. The locking feature is also useful when fitting the wrench socket onto a nut or bolt.

As an example, U.S. Pat. No. 4,581,959 discloses a locking flex-head which pivots orthogonally to the plane of the wrench head. A yoked handle is shown carrying a pivotably mounted tool head. A parallelepiped is integrally formed rearwardly of the tool head, and the parallelepiped is carried axially by the yoked handle. Each face of the parallelepiped is defined by a transverse notch. A spring-mounted detent pin extends from the handle and engages the notches on the parallelepiped faces. The tool head can be locked in one of six incremental angular positions with respect to the handle by engaging the spring-mounted detent in the respective notch.

Although the '959 patent accomplishes the basic function of a locking flex head tool, in so doing it creates other problems. For example, the tool head with integral parallelepiped is exceedingly difficult and costly to manufacture. In addition, the full measure of torque at the parallelepiped is imparted on the detent pin. This creates a highly focussed stress point which leads to breakage of the detent pin and/or deterioration of the notches. Furthermore, it is difficult to securely lock the parallelepiped in position. To secure the locking means an adjustment knob must be turned to the tightest possible position. It would be far more advantageous if the basic locking flex head function could be accomplished with a simpler, stronger, and more economical design.

More preferable alternatives are shown in U.S. Pat. Nos. 4,901,608 and 4,711,145. Both patents illustrate adjustable angle ratchet wrenches having a tool head pivoted at a hub which has rearwardly protruding teeth. An opposing mechanism mounted in the handle may be moved into engagement with the toothed hub to lock the tool head in place. However, the mechanisms taught for engaging the teeth of the tool head are intricate, exceedingly difficult and costly to manufacture. For instance, five finely machined parts are necessary in the '608 patent (see FIG. 1, refs. 3–6 and 211), and two drill passes must be made through the handle. The manufacturing difficulties are even more apparent in the '145 patent, where an intricate lengthwise borehole must be made through the handle.

It is questionable whether the above-described patents or any other prior art references teach a commercially practical wrench. This is evidenced by the unavailability of any commercial unit incorporating a comparable locking mechanism.

It would be greatly advantageous to provide a flex-head locking mechanism incorporating a minimum of easily manufacturable parts. This would increase the strength and durability of the wrench while reducing manufacturing costs.

SUMMARY OF THE INVENTION

It is, therefore, an object of the present invention to provide a flex-head tool incorporating a locking mechanism of simple design which can be manufactured, assembled, and repaired at minimum expense.

It is another object of the present invention to accomplish the above without sacrificing strength and durability, and in fact, to increase these qualities.

It is a further object of the present invention to provide a locking mechanism comprising a single unitary part which is self-seating within the handle, easily operated, economical to produce, and yet capable of all of the qualities described above.

These and other objects are accomplished by an improvement to a flex-head tool of the type comprising a handle with a bifurcated yoke defined by a pair of legs forwardly of the handle, and a tool head having a hub portion pivotably mounted between the legs of the yoke such that the tool head may be pivotably adjusted about a first axis and in a plurality of desired positions relative to the handle. The improvement includes a locking means for rigidly securing the tool head to the handle in a selected adjusted position. More specifically, the locking means comprises a locking spool received within the yoke rearwardly of the hub portion of the tool head. The locking spool is trapped against axial or forward movement out of the yoke. Likewise, the locking spool is precluded from lateral movement by the yoke and is rotatably seated within the yoke for rotation about a second axis which is substantially at right angles to the first axis around which the tool head is pivoted. Means are also provided for rotating the locking spool. The locking spool has an eccentric portion which is preferably toothed to engage cooperating teeth on the hub portion of the tool head when the locking spool is rotated in one direction, the engaged spool and hub rigidly locking the tool head to the handle and preclude inadvertent movement therebetween.

From another perspective, a flex-head wrench with locking feature is provided. The wrench comprises a handle formed with an integral yoke at one end and a tool head (such as a ratchet head) pivotably connected to the handle at the yoke. The tool head includes a toothed hub facing rearwardly of the pivot into the handle yoke. A locking spool is rotatably seated in the yoke opposite the toothed hub such that the axis of rotation is orthogonal to the hub teeth. The locking spool is formed with a plurality of teeth geared to the hub teeth and extending around a portion of the spool, said spool also being formed with a planar section interrupting the spool teeth. The spool may be rotated into a first position in which the spool teeth engage the hub teeth to lock the tool head at a selected angular position with respect to the handle. Likewise, the spool may be rotated into a second position in which the planar section faces the hub. In the second position, the hub teeth are disengaged to allow pivoting of the tool head.

The basic concept underlying the present invention is as described above. However, it should be understood that various other embodiments as well as certain variations and modifications of the invention are possible. For instance, the invention can be incorporated in all types of wrenches, including combination wrenches. Conceivably, the invention could be incorporated in tools other than wrenches. Hence, the invention may be practiced otherwise than as specifically set forth herein.

BRIEF DESCRIPTION OF THE DRAWINGS

Other objects, features, and advantages of the present invention will become more apparent from the following detailed description of preferred embodiments and certain modifications thereof when taken together with the accompanying drawings, in which.

DETAILED DESCRIPTION OF THE PREFERRED EMBODIMENT(S)

Figure 1:
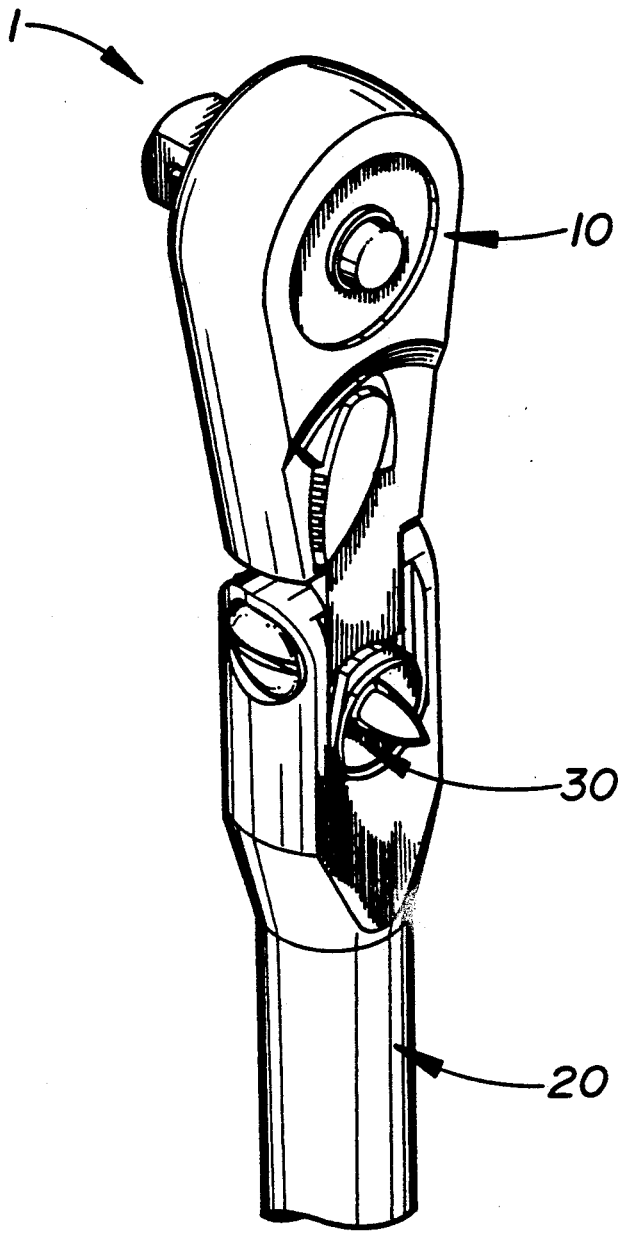
FIG. 1 is a perspective drawing of a ratchet embodiment of the locking flex-head wrench according to the present invention.

FIG. 1 illustrates a perspective view of a locking flex-head wrench 1 in accordance with the preferred embodiment of the present invention.

As shown in FIG. 1, the wrench 1 generally incorporates a tool head 10 such as a ratchet which is pivotably connected to an extending handle 20. The handle 20 pivots orthogonally with respect to the plane of tool head 10 to help avoid obstructions within the turning arc of the wrench.

A locking spool 30 is carried within handle 20 immediately behind the pivot joint of tool head 10. Locking spool 30 may be rotated to a first position which facilitates pivoting of tool head 10 or to a second position in which tool head 10 is locked with respect to the extending handle 20. This locking feature helps in maintaining control of the wrench while high torque is being applied and while a wrench socket is fitted onto a nut or bolt.

Figure 2:
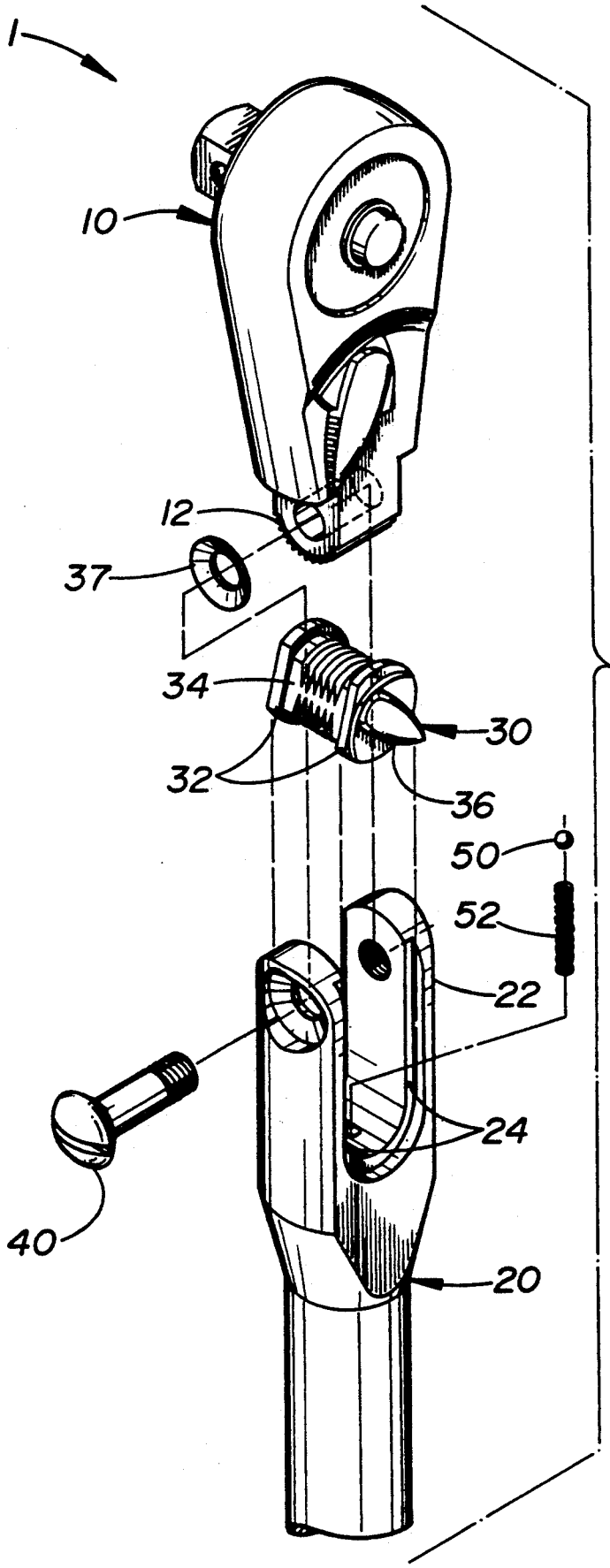
FIG. 2 is an exploded assembly diagram of the locking flex-head wrench of FIG. 1.

FIG. 2 illustrates the manner of assembly of the components shown in FIG. 1. Handle 20 is formed with an integral yoke 22 at one end which comprises a recessed portion flanked by two parallel projections. The interior walls of the projections converge to form a curved interior bearing surface which bounds the recessed portion.

Locking spool 30 is a substantially cylindrical spool which is dimensioned to fit within the recessed portion of handle 20. Locking spool 30 is rotatably carried within the recess against the curved bearing surface. In the preferred embodiment, this is accomplished by forming handle 20 with a channel 24 extending around the rim of the curved bearing surface interiorly of integral yoke 22. An identical channel (not shown) is formed on the opposite side of the handle.

In the preferred embodiment, the locking spool 30 is formed with upper and lower flanges 32 which are sized to fit within the channels 24. This way, locking spool 30 may be inserted onto handle 20 such that flanges 32 are seated within channels 24. Spool 30 is then rotatably carried by the handle 20. It is noteworthy that other means may be used to axially secure locking spool 30 on handle 20. For instance, the rear wall of the curved bearing surface interiorly of integral yoke 22 may be pocketed or otherwise patterned to prevent longitudinal movement of the spool 30.

A lever 36 is integrally formed on the upper flange 32 of spool 30 to facilitate rotation. Lever 36 may take on a variety of shapes as a matter of design choice. Also, a spring 52 and ball 50 are loaded into a bore-hole which extends rearwardly from the curved bearing surface within integral yoke 22. When locking spool 30 is properly seated within handle 20, lever 36 extends rearwardly along handle 20. Spool 30 does not contribute to the overall dimensions of the wrench 1, and there are no obtrusive protruding parts. Spring 52 imparts a biasing force through ball 50 against the rear of spool 30.

Tool head 10 includes an annular hub 12 which fits within yoke 22 of handle 20. Both hub 12 and yoke 22 are defined by a through-bore which is adapted to receive a pivot pin 40 when hub 12 and yoke 22 are properly aligned. Pivot pin 40 is inserted through yoke 22 and hub 12, and the tool head 10 is free to pivot about the pivot pin 40. A compression washer 37 is interposed between the tool head 10 and yoke 22 to provide a more stable pivoting action. Pivot pin 40 may be any captive fastener, for instance, a screw having a countersunk head at one end and threaded or otherwise secured at the other end to anchor it within the projections of handle 20.

When tool head 10 has been pivotably mounted on handle 20, the hub 12 urges spool 30 against the spring 52 and ball 50 toward the bearing surface at the rear of the recessed portion of handle 20. Spool 30 becomes trapped within the yoke 22 of handle 20.

The annular hub 12 of tool head 10 extends rearwardly of pivot pin 40 into the recess of handle 20. The rearwardly facing portion of hub 12 is formed with a series of horizontal teeth.

Figure 3A:
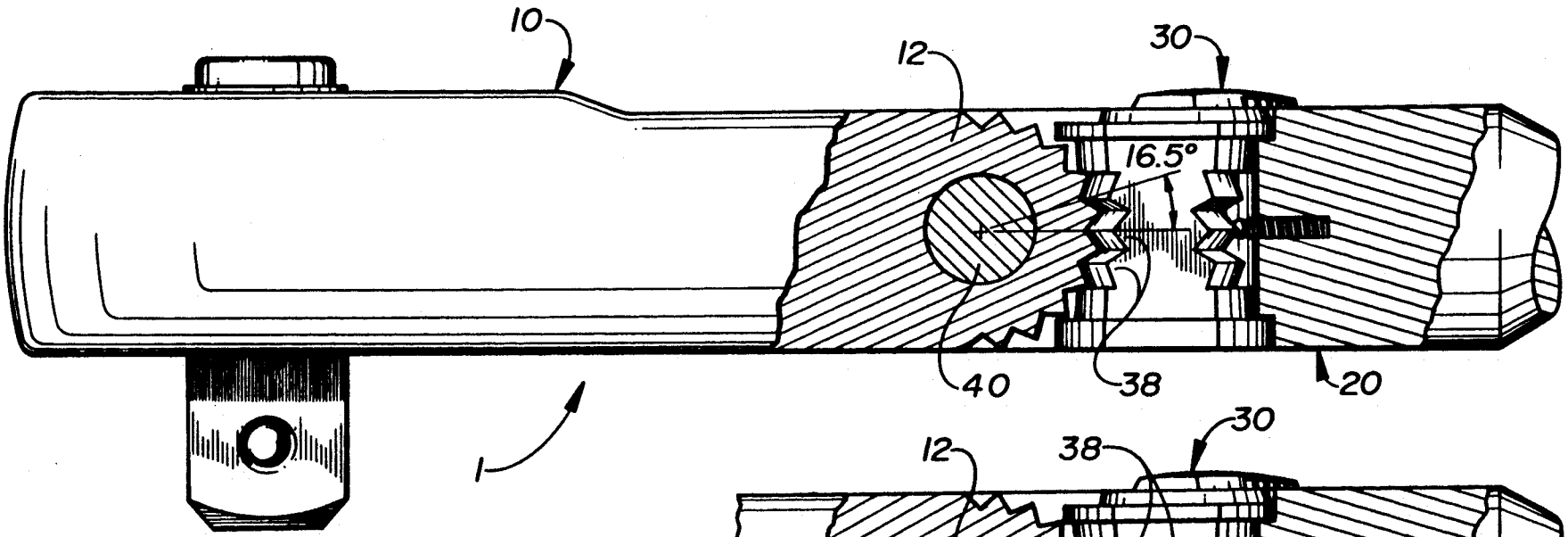
FIG. 3A is a cross-sectional view of the locking flex-head wrench of FIG. 1.
Figure 3B:
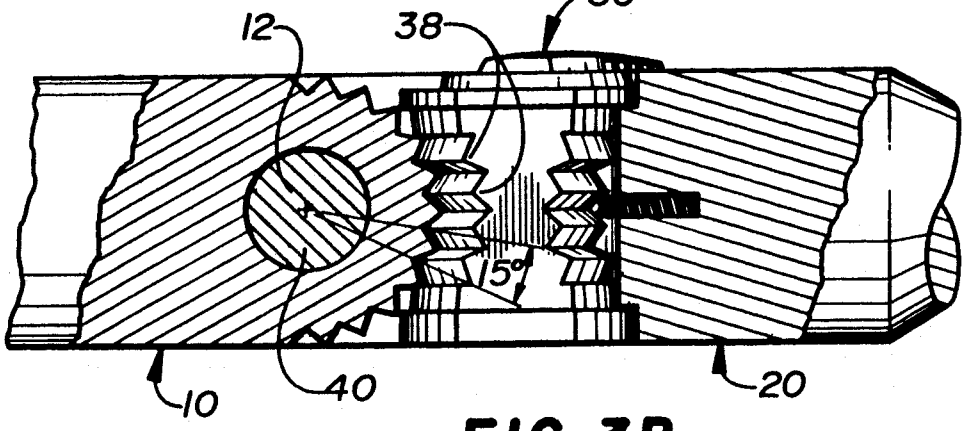
FIG. 3B is a magnified view of the cross-section of FIG. 3A illustrating an alternate engagement of locking spool 30.

As shown in FIGS. 3A and 3B, locking spool 30 is formed with a cooperating series of teeth 38 extending around a portion of spool 30. The teeth 38 of locking spool 30 may be engaged with the teeth of hub 12 to lock the tool head 10 in place.

In the preferred embodiment of spool 30, the mid-section (including teeth 38) is formed with a slight curvature corresponding to a radius extending from the pivot joint of tool head 10. This way, the teeth of hub 12 better conform to the teeth 38 of spool 30, and a significantly stronger engagement is achieved.

FIG. 3A illustrates the preferred embodiment in which spool teeth 38 and hub 12 teeth are formed at 16.5° intervals along a radius measured from the pivot joint of tool head 10. There are a total of five teeth along spool 30 which are engaged along eighteen teeth facing outward from hub 12. Handle 20 may be locked in 16.5° increments between a + or −90° angle with respect to tool head 10 (it has been found that the flex-head feature lacks utility at angles beyond ±45° because very little torque can be imparted). Intervals of 16.5° are presently preferred because they strike a most practical balance between strength and adjustability. However, it has been found that intervals of between 10°–17° also yield excellent results, and indeed, any size interval may be chosen depending on the specialized needs of the user.

As a further example, FIG. 3B illustrates spool teeth 38 and hub 12 teeth which are formed at 15° intervals measured along the radius extending from the pivot joint of tool head 10. Consequently, there are a total of twelve teeth facing outward from hub 12, and the handle 20 may be locked in 15° increments with respect to tool head 10. By decreasing the size and spacing of teeth 38 in this manner, the resolution of the locking increments can be increased at the expense of the engagement strength.

Figure 4:
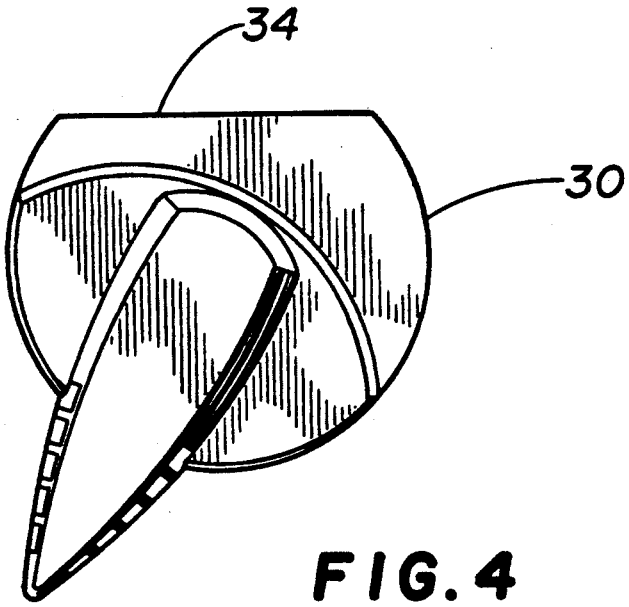
FIG. 4 is a top view of the locking spool 30 used in the locking flex-head wrench of FIG. 1.
Figure 5:
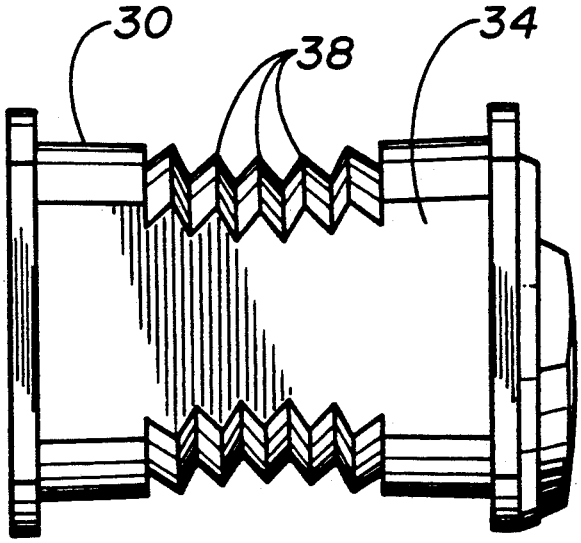
FIG. 5 is a side view of the locking spool 30 used in the locking flex-head wrench of FIG. 1.

As shown in FIGS. 4 and 5, the locking spool 30 is formed with a planar section 34 interrupting the teeth 38. When locking spool 30 is rotated to a point where planar section 34 oppose the hub 12 of tool head 10, the teeth of spool 30 are disengaged from the teeth of hub 12. Hence, tool head 10 may be freely pivoted about the pivot pin 40.

Figure 6:
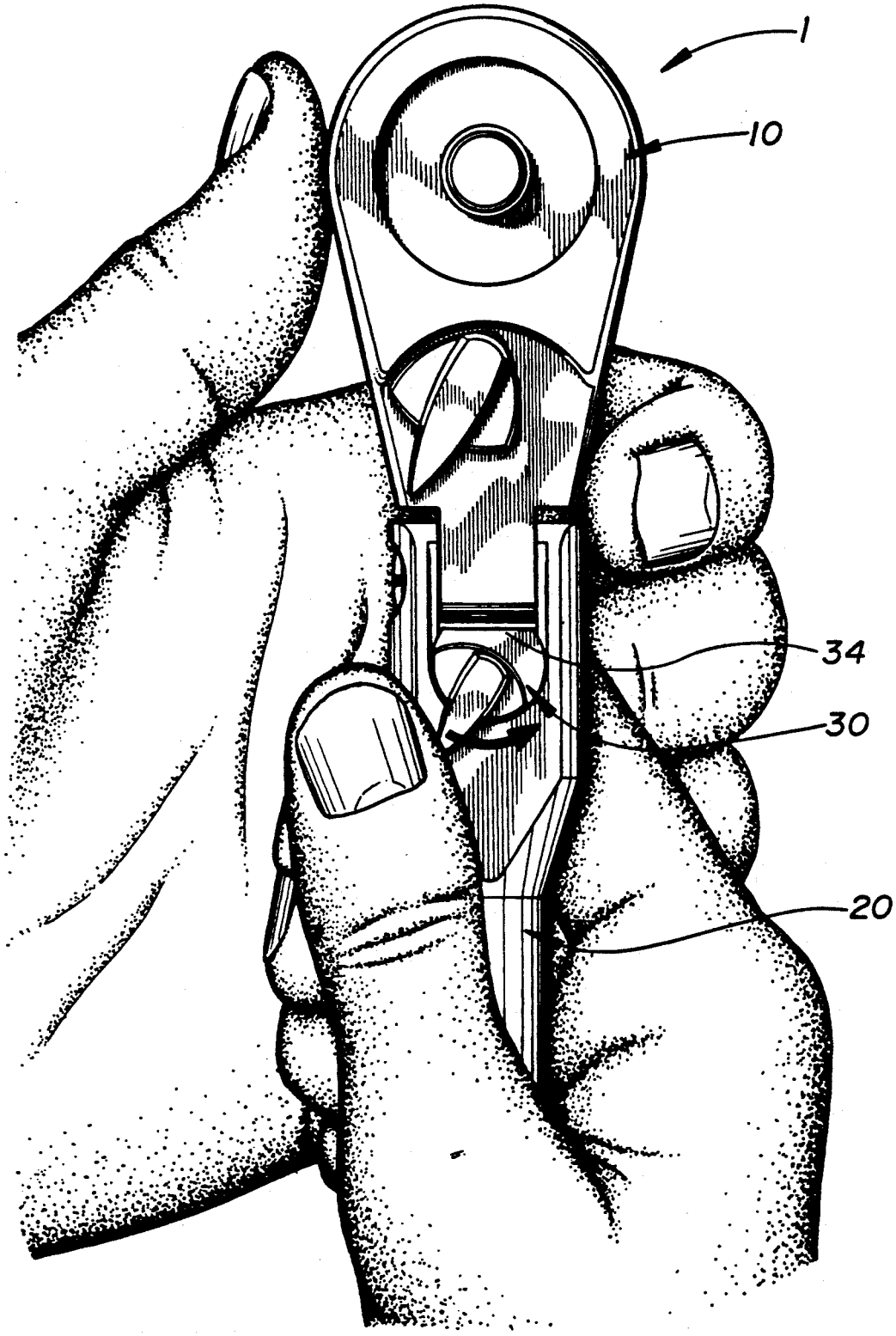
FIG. 6 is a perspective drawing illustrating the operation of the locking feature of FIG. 1.

The above-described operation is clear in FIG. 6. As shown, locking spool 30 is initially in a first position wherein planar surface 34 faces the teeth of hub 12 and the teeth of locking spool 30 are not engaged with those of hub 10. In this position, handle 20 and tool head 10 may be freely pivoted and the operator may adjust tool head 10 to any desired angular position with respect to handle 20. By adjusting lever 36 in the direction indicated by the arrow, the operator rotates spool 30 to a second position wherein the teeth of hub 12 engage the teeth of spool 30, thereby locking tool head 10 in position. If desired, the sides of teeth 38 and/or the sides of the teeth of the locking spool 30 may be rounded or angled to help channel the two sets of teeth into alignment when spool 30 is rotated into the second position.

Figure 7A:
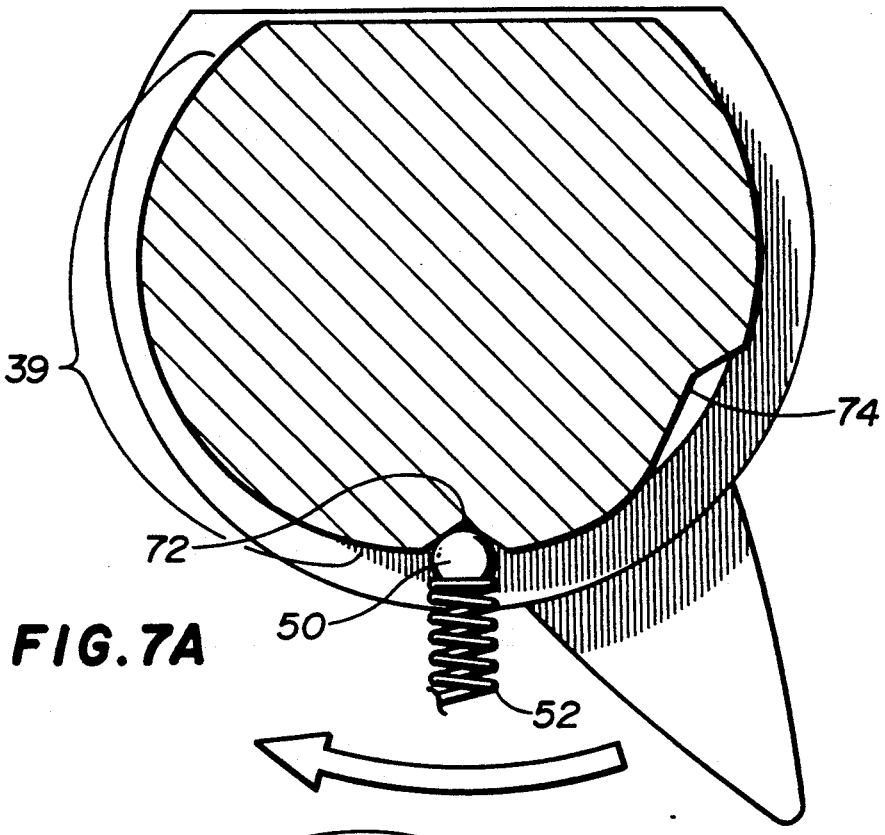
FIGS. 7A and 7B are bottom section views of the locking spool 30 showing the operation of spring 50 and ball 52.
Figure 7B:
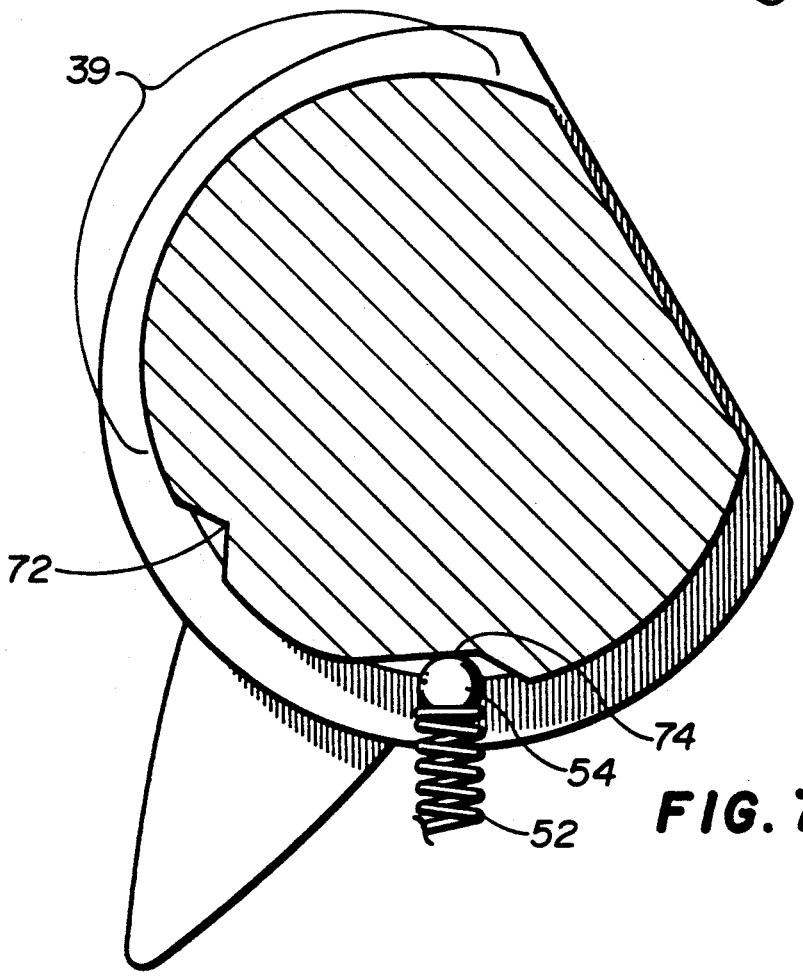

FIGS. 7A and 7B show the operation of spring 50 and ball 52. When locking spool 30 is properly seated within handle 20, spring 50 imparts a biasing force through ball 54 against the rear of spool 30. In the preferred embodiment spool 30 is formed with two cavities 7 and 74 formed along the rearward periphery and facing the spring 52 and ball 50. Cavities 72 and 74 index the first and second positions of spool 30. More specifically, as shown in FIG. 7A, cavity 72 biases locking spool 30 into the first position wherein handle 20 and tool head 10 may be freely pivoted. Lever 36 may be adjusted in the direction indicated by the arrow to attain the position shown in FIG. 7B. Here, the tool head 10 is locked in position. As the spool 30 is rotated, ball 54 will gradually invade cavity 74. This will serve to bias the spool 30 into the second (locked) position. It should be noted that spring 52 and ball 50 may be replaced with a unitary elastomeric member.

FIGS. 7A and 7B also illustrate a preferred feature whereby the teeth of locking spool 30 are formed with a slight degree of eccentricity relative to the axis of spool 30 rotation. This eccentricity is calculated to accommodate for manufacturing tolerances in the locking components. The eccentric portion 39 begins proximate planar surface 34, ends proximate cavity 72, and reaches a maximum therebetween. This way, as lever 36 is operated in the direction indicated by the arrow, the spool 30 will move out of the position indexed by cavity 72. At first, the eccentric portion 39 is askance of the hub 12 and the teeth of spool 30 do not engage with those of hub 10. However, as the spool 30 continues to rotate, the eccentric portion 39 moves toward hub 12 until the spool teeth 38 firmly engage the hub teeth and further rotation of spool 30 is prevented. This gradual engagement is made possible by the eccentric spool teeth 38, and the degree of eccentricity can be easily calculated to accommodate common manufacturing tolerances such as ±0.01 to 0.015 inches.

Figure 8:
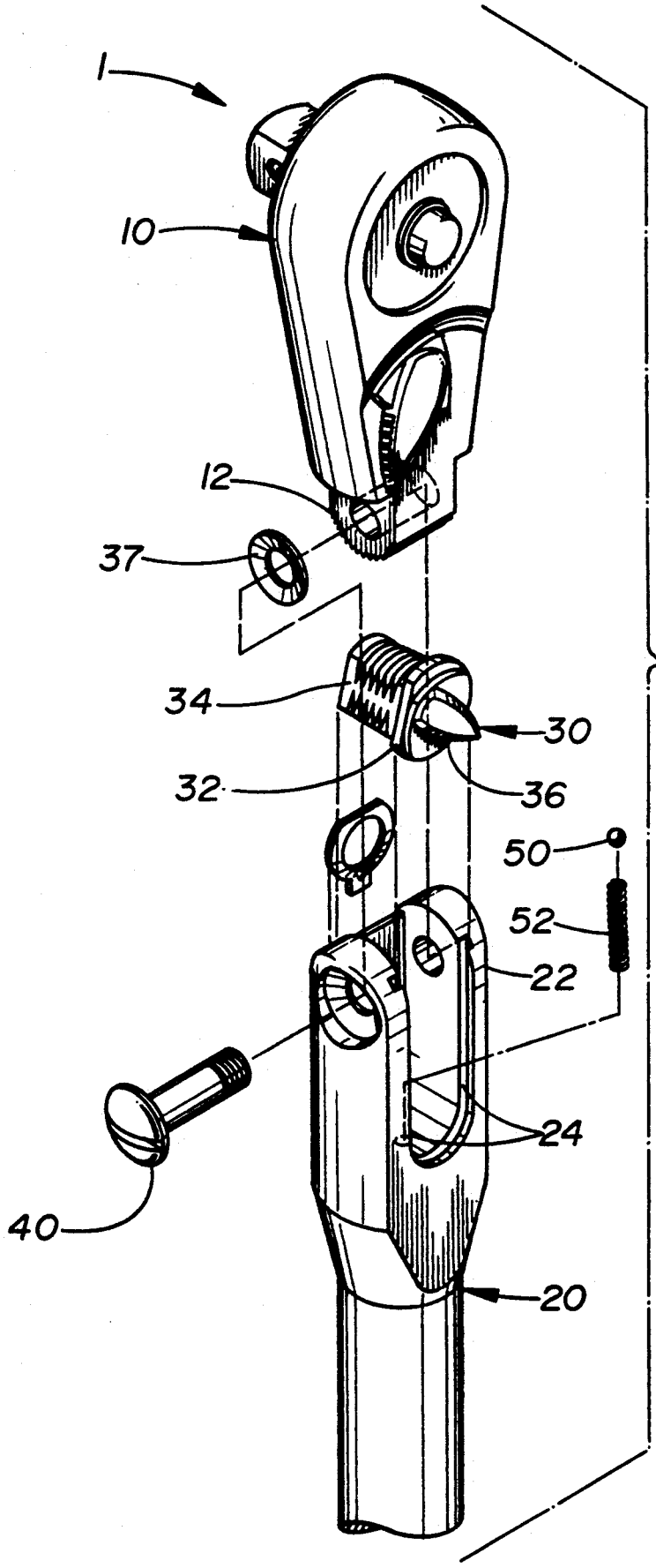
FIG. 8 is an exploded assembly diagram of an alternate embodiment of the locking flex-head wrench of FIG. 1 which replaces spring 50 and ball 52 with resilient washer 54.
Figure 9:
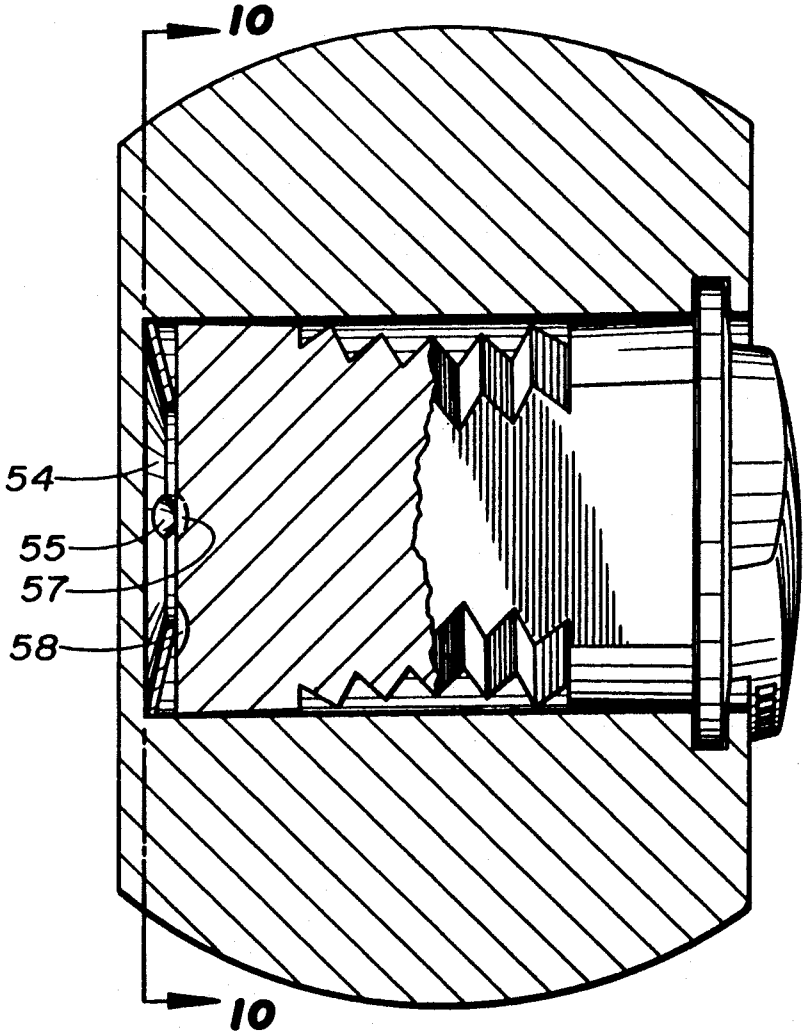
FIG. 9 is a cross-sectional side-view of the wrench embodiment shown in FIG. 7.
Figure 10:
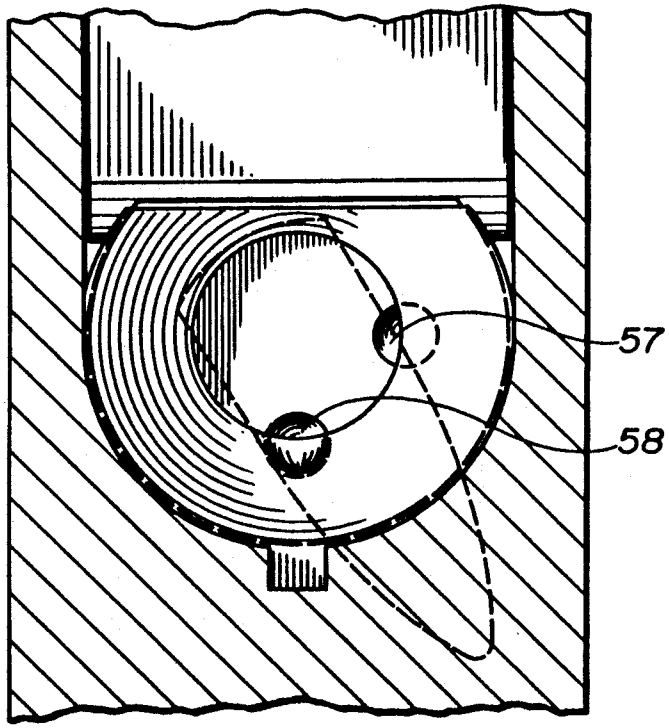
FIG. 10 is a top section view of the locking spool 30 and resilient washer 54 taken along the line A—A of FIG. 9.

FIGS. 8–10 illustrate an alternate embodiment where the spring 50 and ball 52 of FIGS. 7A and 7B are replaced with resilient washer 54. In this embodiment, the yoke 22 is partially closed at the bottom end and resilient washer 54 is interposed between the closed end and spool 30. The bottom of spool 30 is formed with two cavities 57 and 58, and resilient washer 54 is formed with a small protuberance 55 facing upwardly toward cavities 57 and 58. When locking spool 30 is properly seated on washer 54, protuberance 55 invades one of cavities 58 and 57, thereby biasing locking spool 30 into the first and second positions, respectively.

Figure 11:
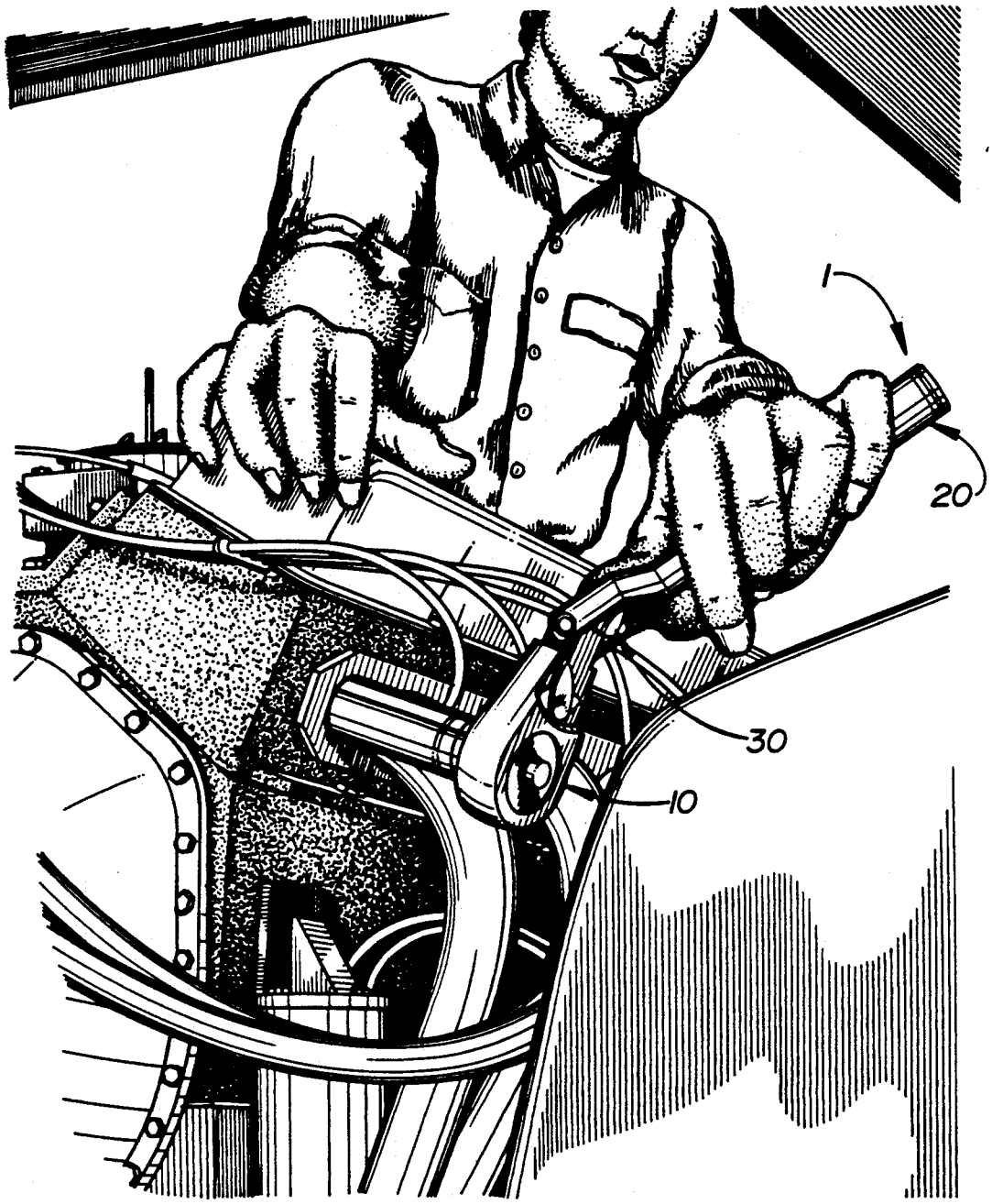
FIG. 11 is a pictorial drawing illustrating the operation of the locking flex-head wrench of FIG. 1.

As shown in FIG. 11, the locking flex-head ratchet wrench of the present invention has important benefits when working in crowded and/or enclosed spaces. Moreover, the entire locking feature can be accomplished with a single additional component (spool 30) and slight modifications to a conventional tool head 10 and handle 20. Moreover, the spool 30 (with integral planar section 34) can be easily manufactured, for example, by investment casting. Hence, the locking mechanism is extremely inexpensive to manufacture, assemble, and repair. In addition, the simplicity of design is achieved without detracting from the strength and durability of the wrench 1.

Having now fully set forth the preferred embodiment and certain modifications of the concept underlying the present invention, various other embodiments as well as certain variations and modifications of the embodiments herein described will obviously occur to those skilled in the art upon becoming familiar with said underlying concept. It is to be understood, therefore, that within the scope of the appended claims, the invention may be practiced otherwise than as specifically set forth herein.

We claim:

1. A locking flex-head tool, comprising:
a handle formed with an integral yoke at one end;
a tool head coupled to said yoke at a pivot, said tool head having a toothed hub facing rearwardly of said pivot into said yoke;
a locking spool rotatably carried in said yoke opposite the toothed hub such that its axis of rotation is orthogonal to the hub teeth, the locking spool further comprising,
a plurality of spool teeth geared to said hub teeth and extending around a portion of said spool, and
whereby said spool may be rotated into a first position in which said spool teeth engage said hub teeth to lock said tool head in a selected angular position with respect to said handle, and said spool may be rotated into a second position in which said planar section faces said hub to allow pivoting of said tool head.

2. The locking flex-head tool according to claim 1, wherein said tool head further comprises a wrench head.

3. The locking flex-head tool according to claim 1, wherein said wrench head further comprises a ratcheting socket wrench head.

4. The locking flex-head tool according to claim 1, wherein said portion of said locking spool around which said spool teeth extend is concave, thereby improving engagement of said spool teeth with said hub teeth.

5. The locking flex-head tool according to claim 4, wherein said concave portion of said locking spool is formed with a curvature defined by a radius extending from a point where said tool head is pivoted at said yoke.

6. The locking flex-head tool according to claim 1, wherein said hub teeth are formed around said hub within a range of between 10°–17° increments.

7. The locking flex-head tool according to claim 6, wherein said hub teeth are formed around said hub at 16.5° increments.

8. The locking flex-head tool according to claim 6, wherein said hub teeth and spool teeth are formed at 15° increments.

9. The locking flex-head tool according to claim 7, wherein said hub teeth and spool teeth are formed at 10° increments.

10. The locking flex-head tool according to claim 1, wherein said plurality of spool teeth extend eccentrically around a portion of said spool to provide a gradual engagement between said spool teeth and said hub teeth as said spool is rotated into said first position.

11. A locking flex-head tool, comprising:
a handle formed with an integral yoke at one end;
a tool head pivoted at said yoke, said tool head having a toothed hub extending into a hollow of said yoke;
a locking spool rotatably carried in said hollow of said yoke, said spool having an axis of rotation orthogonal to the hub teeth, the locking spool further comprising,
a top flange and a bottom flange for maintaining said spool within said yoke,
a plurality of spool teeth geared to said hub teeth and extending around a portion of said spool,
a planar section interrupting said spool teeth; and
a detent means carried by said handle for spring-biasing said locking spool against said toothed hub;
whereby said locking spool may be rotated into a first position in which said spool teeth engage said hub teeth to lock said tool head in a selected angular position with respect to said handle, and said spool maya be rotated into a second position in which said planar section faces said hub to allow pivoting of said tool head.

12. The locking flex-head tool according to claim 11, wherein said tool head further comprises a wrench head.

13. The locking flex-head tool according to claim 11, wherein said wrench head further comprises a socket wrench head.

14. The locking flex-head tool according to claim 11, wherein said locking spool is formed with a first cavity opposite said planar section, said detent means fitting within said first cavity during rotation of said locking spool to bias said locking spool in said second position.

15. The locking flex-head tool according to claim 14, wherein said locking spool is formed with a second cavity alongside said first cavity, said detent means fitting within said second cavity during rotation of said locking spool to bias said locking spool in said first position.

16. The locking flex-head tool according to claim 11, wherein said handle is formed with a hole bored inwardly from the hollow of said yoke, and said detent means further comprises a spring having a contact bearing mounted at one end, another end of said spring being inserted in said hole such that said contact bearing protrudes from said hole and bears against said locking spool for spring-biasing said locking spool against said toothed hub.

17. The locking flex-head tool according to claim 11, wherein said detent means further comprises a unitary resilient detent member carried in said handle.

18. The locking flex-head tool according to claim 11, wherein said plurality of spool teeth extend eccentrically around a portion of said spool to provide a gradual engagement between said spool teeth and said hub teeth as said spool is rotated into said first position.

19. A locking flex-head tool, comprising:
a handle formed with a yoke at one end defined by laterally extending legs and a hollow therebetween, said hollow being partially covered on one side by a shelf;
a tool head pivoted at said yoke, said tool head having a toothed hub extending into said hollow;
a resilient washer seated on said shelf;
a locking spool rotatably carried in said hollow of said yoke and having an axis of rotation orthogonal to the hub teeth, said washer being interposed between said locking spool and shelf and biasing said locking spool, the locking spool further comprising,
a plurality of spool teeth geared to said hub teeth and extending around a portion of said spool, and
a planar section interrupting said spool teeth;

whereby said spool may be rotated into a first position in which said spool teeth engage said hub teeth to lock said tool head in a selected angular position with respect to said handle, and said spool may be rotated into a second position in which said planar section faces said hub to allow pivoting of said tool head.

20. The locking flex-head tool according to claim 19, wherein said tool head further comprises a wrench head.

21. The locking flex-head tool according to claim 19, wherein said wrench head further comprises a socket wrench head.

22. The locking flex-head tool according to claim 19, wherein said locking spool is formed with a first cavity adjoining said washer, and said washer having a protuberance biased against said locking spool, said protuberance fitting within said first cavity during rotation of said locking spool to bias said locking spool in said second position.

23. The locking flex-head tool according to claim 22, wherein said locking spool is formed with a second cavity alongside said first cavity, said protuberance fitting within said second cavity during rotation of said locking spool to bias said locking spool in said first position.

24. The locking flex-head tool according to claim 19, wherein said plurality of spool teeth extend eccentrically around a portion of said spool to provide a gradual engagement between said spool teeth and said hub teeth as said spool is rotated into said first position.

25. In a flex-head tool comprising a handle including a bifurcated yoke having a pair of legs forwardly of the handle, and further comprising a tool head having a hub portion pivotably mounted between the legs of the yoke, such that the tool head may be pivotably adjusted about a first axis and in a plurality of desired positions relative to the handle, the improvement which comprises locking means for rigidly securing the tool head to the handle in a selected adjusted position, said locking means comprising a locking spool received within the yoke rearwardly of the hub portion of the tool head, thereby trapping the locking spool against movement longitudinally of the handle and forwardly out of the yoke, means on the locking spool and cooperating with means on the yoke for precluding movement of the locking spool laterally of the yoke, the locking spool being rotatably disposed within the yoke about a second axis which is substantially at right angles to the first axis about which the tool head is pivotably adjustable, means accessible externally of the handle for rotating the locking spool, the locking spool having an eccentric portion engaging the hub portion of the tool head when the locking spool is rotated in one direction, and said locking spool having a planar portion contiguous with the eccentric portion thereof for disengaging the hub portion of the tool head when the locking spool is rotated in another direction, and cooperating gear teeth on the hub portion and on the eccentric portion of the locking spool for rigidly locking the tool head to the handle to preclude inadvertent movement therebetween when the eccentric portion of the locking spool is engaged with the hub portion of the tool head.

26. The improvement of claim 25, wherein the means on the locking spool cooperating with means on the yoke for precluding movement of the locking spool laterally of the yoke further comprises a flange on the locking spool and a groove on the yoke for seating said flange.

27. The improvement of claim 25, wherein the means accessible externally of the handle for rotating the locking spool comprises a lever formed integrally with the locking spool for conjoint movement in unison.

28. In a flex-head ratchet wrench comprising a handle including a bifurcated yoke having a pair of legs forwardly of the handle, and further comprising a tool head having a hub portion pivotably mounted between the legs of the yoke, such that the tool head may be pivotably adjusted about a first axis and in a plurality of desired positions relative to the handle, the improvement which comprises locking means for rigidly securing the tool head to the handle in a selected adjusted position, said locking means comprising a locking spool received within the yoke rearwardly of the hub portion of the tool head, thereby trapping the locking spool against movement longitudinally of the handle and forwardly out of the yoke, a flange on the locking spool and a groove on the yoke for seating said flange and for precluding movement of the locking spool laterally of the yoke, the locking spool being rotatably disposed within the yoke about a second axis which is substantially at right angles to the first axis about which the tool head is pivotably adjustable, a lever formed integrally with the locking spool for conjoint movement in unison, said lever being accessible externally of the handle for rotating the locking spool, the locking spool having an eccentric portion engaging the hub portion of the tool head when the locking spool is rotated in one direction, and a planar portion contiguous with the eccentric portion thereof, and cooperating means on the hub portion and locking spool respectively, comprising respective gear teeth on the hub portion and on the eccentric portion of the locking spool, the respective gear teeth being substantially aligned with each other and interfering therebetween, whereby the eccentric portion of the locking spool may be engaged with the hub portion of the tool head to rigidly lock the tool head to the handle and preclude inadvertent movement therebetween.

* * * * *